US006095454A

United States Patent [19]

Simmons, Jr. et al.

[11] Patent Number: 6,095,454

[45] Date of Patent: Aug. 1, 2000

[54] CUSHIONING CONVERSION SYSTEM AND METHOD WITH COMBINATION STOCK ROLL STORAGE RACK

[75] Inventors: James A. Simmons, Jr., Painesville Township; Thomas E. Manley, Mentor, both of Ohio; Luther Paul Myers, Pittsburgh, Pa.

[73] Assignee: Ranpak, Corp., Concord Township, Ohio

[21] Appl. No.: 09/225,764

[22] Filed: Jan. 5, 1999

Related U.S. Application Data

[60] Provisional application No. 60/070,471, Jan. 5, 1998, and provisional application No. 60/082,954, Apr. 24, 1998.

[51] Int. Cl.[7] ..... B65H 19/00

[52] U.S. Cl. ..... 242/560.3; 242/560.2; 242/561; 242/559.3; 242/559; 414/745.9; 414/911

[58] Field of Search ..... 242/560.3, 560.2, 242/561, 560.1, 560, 559.3, 559; 414/746.4, 746.1, 745.9, 745.7, 911

[56] References Cited

U.S. PATENT DOCUMENTS

| | | | |
|---|---|---|---|
| 2,508,566 | 5/1950 | Dunton | 242/559.3 |
| 2,685,418 | 8/1954 | Moore | 242/561 X |
| 3,219,206 | 11/1965 | Cocker, III | 242/559.3 |
| 3,695,539 | 10/1972 | Lindstaedt | 242/559 |
| 3,977,617 | 8/1976 | Salmon | 242/561 X |
| 4,026,198 | 5/1977 | Ottaviano . | |
| 4,085,662 | 4/1978 | Ottaviano | 493/354 |
| 4,557,716 | 12/1985 | Ottaviano . | |
| 4,619,635 | 10/1986 | Ottaviano . | |
| 4,650,456 | 3/1987 | Armington . | |
| 4,708,300 | 11/1987 | Goetz | 242/561 X |
| 4,750,896 | 6/1988 | Komaransky | 493/357 |
| 4,840,321 | 6/1989 | Focke et al. | 242/561 X |
| 5,123,889 | 6/1992 | Armington et al. . | |
| 5,297,919 | 3/1994 | Reichental et al. | 414/349 |
| 5,393,009 | 2/1995 | Neri | 242/559.3 |
| 5,571,067 | 11/1996 | Ratzel . | |
| 5,658,229 | 8/1997 | Armington et al. | 493/363 |
| 5,749,539 | 5/1998 | Ratzel et al. | 242/598.3 |
| 5,803,893 | 9/1998 | Armington et al. . | |
| 5,836,538 | 11/1998 | Lencoski et al. . | |
| 5,891,010 | 4/1999 | Kobben et al. . | |

*Primary Examiner*—Donald P. Walsh
*Assistant Examiner*—Minh-Chau Pham
*Attorney, Agent, or Firm*—Renner, Otto, Boisselle & Sklar, LLP

[57] ABSTRACT

A cushioning conversion system (10) and method wherein a stock roll storage rack (14) is used to support at least one and preferably a plurality of stock rolls (21) at the same level as the stock roll holder (19) of a cushioning conversion machine (12). The stock roll storage rack (14), which stores the stock rolls (21) in a substantially horizontal array, enables an operator to easily load the machine (12) without having to lift a stock roll (21) to the height of the stock roll holder (19). Also, plural stock roll storage racks (14) can be used interchangeably, whereby one can be loaded with stock rolls (21) by an attendant while the other is used to load stock rolls (21) onto the cushioning conversion machine (12). The stock roll storage rack (14) includes a stand (70) and a stock roll storage shelf (72) vertically adjustable on the stand (70) to match the height of the storage shelf (72) to the height of a stock roll holder (19) on the conversion machine (12). A locking device (330) for selectively locking the storage rack (14) in relation to the cushioning conversion machine (12) and/or a catching device (400) for catching a spindle-less stock roll may also be provided.

33 Claims, 8 Drawing Sheets

CUSHIONING CONVERSION SYSTEM AND METHOD WITH COMBINATION STOCK ROLL STORAGE RACK

This application claims benefit to U.S. Provisional applications 60/070471 filed Jan. 5, 1998 and Provisional 60/082954 filed Apr. 24, 1998.

FIELD OF THE INVENTION

The invention herein described relates generally to a cushioning conversion system and method, and, more particularly, to improvements in devices and methods for storing and loading rolls of sheet stock material on a cushioning conversion machine for conversion into a dunnage product.

BACKGROUND OF THE INVENTION

In the process of shipping an item from one location to another, protective packaging material is often placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and plastic foam peanuts is their effect on our environment. Quite simply, these plastic packaging materials are not biodegradable, and therefore they cannot avoid further multiplying our planet's already critical waste disposal problems. The nonbiodegradability of these packaging materials has become increasingly important in light of many industries adopting more progressive policies in terms of environmental responsibility.

The foregoing and other disadvantages of conventional plastic packaging materials have made paper protective packaging material a popular alternative. Paper is biodegradable, recyclable and composed of a renewable resource, making it an environmentally responsible choice for conscientious shippers.

While paper in sheet form could possible be used as a protective packaging material, it is usually preferable to convert the sheets of paper into a relatively low density pad-like cushioning or dunnage product. This conversion may be accomplished by a cushioning conversion machine, such as that disclosed in commonly assigned U.S. Pat. No. 5,123,889. The conversion machine disclosed in U.S. Pat. No. 5,123,889 converts sheet-like stock material, such as paper in multi-ply form, into relatively low density pads. Specifically, the machine converts this stock material into a continuous unconnected strip having lateral pillow-like portions separated by a thin central band. This strip is connected as by coining along its central band to form a coined strip which is cut into sections, or pads, of a desired length. The stock material preferably consists of two or three superimposed webs or layers of biodegradable, recyclable and reusable thirty-pound Kraft paper rolled onto a hollow cylindrical tube. A typical thirty-inch wide roll of this three ply paper, which is approximately four hundred and fifty feet long, will weigh about 35 pounds (about 16 kg) and will provide cushioning equal to approximately four fifteen cubic inch bags of plastic foam peanuts while at the same time requiring less than one-thirtieth the storage is space. The stock material also may be supplied in larger rolls weighing, for example, 105 pounds (about 48 kg).

The multi-ply roll of sheet stock material heretofore has been supported at the upstream end of a conversion machine by means of a spindle in the form of an axle rod that passes through the core of the stock roll with its ends projecting therebeyond for cradled receipt in respective laterally spaced apart spindle supports of a stock roll holder. The spindle supports may be provided, for example, directly on the frame of the cushioning conversion machine or on a mobile cart as shown in U.S. Pat. No. 5,123,889.

A stock roll would typically be loaded by positioning a stock roll on the floor or on a stand near the cushioning conversion machine. The axle rod would then be inserted into the center hole in the plug at one end of the roll, through the core tube and then through the center hole in the plug at the opposite end of the roll. The stock roll could then be raised by grasping and lifting the ends of the axle rod that projected from opposite ends of the stock roll. The loading operation is completed by lowering the projecting ends of the axle rod onto the laterally spaced apart spindle supports that have recesses for cradles receipt and retention of the axle rod.

For some applications the machine may be disposed several feet above the floor, sometimes at or above head level, which makes loading a stock roll on the machine more difficult because of the greater height to which the stock roll must be lifted. Also, the machine may be positioned over a conveyor which may require the operator to reach over the conveyor when loading a stock roll on the machine. Also, in some installations, a person other than the machine operator may be designated to lift and load a stock roll on the machine. In these situations, delay may arise when such persons or attendant, is not at the machine to load a stock roll on the machine. Consequently, the operator of the machine must wait until such person returns to the machine and such delay may be of considerable length when the attendant is busy with another task, such as loading a stock roll on another machine or machines.

Accordingly, a need existed for a way of storing stock rolls for loading on a cushioning conversion machine when the machine is disposed more than a few feet above the floor, is disposed above a conveyor or other structure which requires an operator to reach over the structure when loading the stock roll on the machine, and/or when an attendant other than the machine operator is used to lift and load the stock rolls on the machine.

SUMMARY OF THE INVENTION

The present invention provides a cushioning conversion system and method wherein a stock roll storage rack is used to support at least one and preferably a plurality of stock rolls at the same level as the stock roll holder of a cushioning conversion machine. This enables an operator to easily load the machine without having to lift the stock roll to the height of the stock roll holder and/or without having to wait for an attendant to lift and load a stock roll on the machine. Also, plural stock roll storage racks can be used interchangeably, whereby one can be loaded with stock rolls by an attendant while the other is used to load stock rolls onto the cushioning conversion machine.

In a preferred embodiment of the invention, the stock roll storage rack includes a stock roll storage shelf preferably in the form of a tray. The tray preferably has an inclined bottom wall for supporting a plurality of stock rolls in a generally horizontal, preferably stacked, array for sequential loading onto the stock roll holder. The tray further includes an abutment at a rear end of the bottom wall and an exit passage at the forward end of the bottom wall. The bottom wall is inclined to the horizontal, preferably in a direction that causes the stock rolls supported thereon to roll rearwardly toward and against the abutment. Accordingly, the leading one of the stock rolls is rolled up a slight incline to the exit passage for loading onto a stock roll holder of the conversion machine.

Further in accordance with a preferred embodiment of the invention, the stock roll holder includes a pair of laterally spaced apart stock roll spindle supports for supporting the ends of a spindle on which the stock roll can be supported for rotation and paying out of stock material to the conversion assemblies. The stock roll storage shelf has a loading ramp terminating at the forward end thereof at the same level as the stock roll support. The loading ramp includes a pair of laterally spaced apart rails projecting beyond the exit passage of the storage tray. The rails have inclined ramp surfaces over which the ends of a stock rolls spindle can pass for loading the stock roll onto the stock roll spindle supports. The conversion machine and the storage rack may include cooperating interengageable locating devices for removably positioning the storage rack in relation to the machine and/or a locking device for selectively locking the storage rack in relation to the machine.

In a preferred system, the conversion machine is mounted on a stand for vertical adjustment between a plurality of different heights, and the stock roll storage shelf is mounted on a stand for vertical adjustment between a plurality of different heights. For positioning the machine and storage shelf above a conveyor, the conversion machine and stock roll storage shelf may both be cantilevered to one side of their respective stands.

With the cushioning conversion system according to the present invention, a plurality of stock rolls may be stored on the stock roll storage rack and the stock roll storage rack positioned adjacent the stock roll holder of the cushioning conversion machine. Preferably, a spindle is placed through the leading stock roll (or, in other words, the stock roll closest to the stock roll holder) whereby the ends of the spindle extend laterally beyond the loading ramps and the stock roll holder. The stock roll is then pushed so that it rolls up the loading ramp, its weight being supported by the tray's bottom wall. Once the pushed stock roll reaches the end of the bottom wall, it passes into a transition region in which the weight of the stock roll is supported by the ends of the spindle resting on the rail top surfaces and the top surfaces of the spindle supports.

The system may further comprise a catching device which at least partially defines a window in the transition region downstream of the stock roll storage rack. The window is dimensioned to prevent the passage of a stock roll therethrough whereby a stock roll will not fall therethrough. In this manner, should a spindle inadvertently not be inserted through a stock roll to be loaded, the spindle-less stock roll will be caught in the window and must only be lifted a slight distance for insertion of the spindle and completion of the loading process.

The present invention also provides a new spindle for supporting a stock roll on a stock roll holder and facilitating loading of a stock roll on the stock roll holder. The spindle has a pair of annular grooves in which the loading ramp rails are engageable, respectively, for limiting lateral shifting movement of the spindle relative to the loading ramp rails. The spindle preferably has adjacent one end thereof a stop collar for preventing over-insertion of the spindle into the stock roll.

The present invention provides the foregoing and other features hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Figure 1:
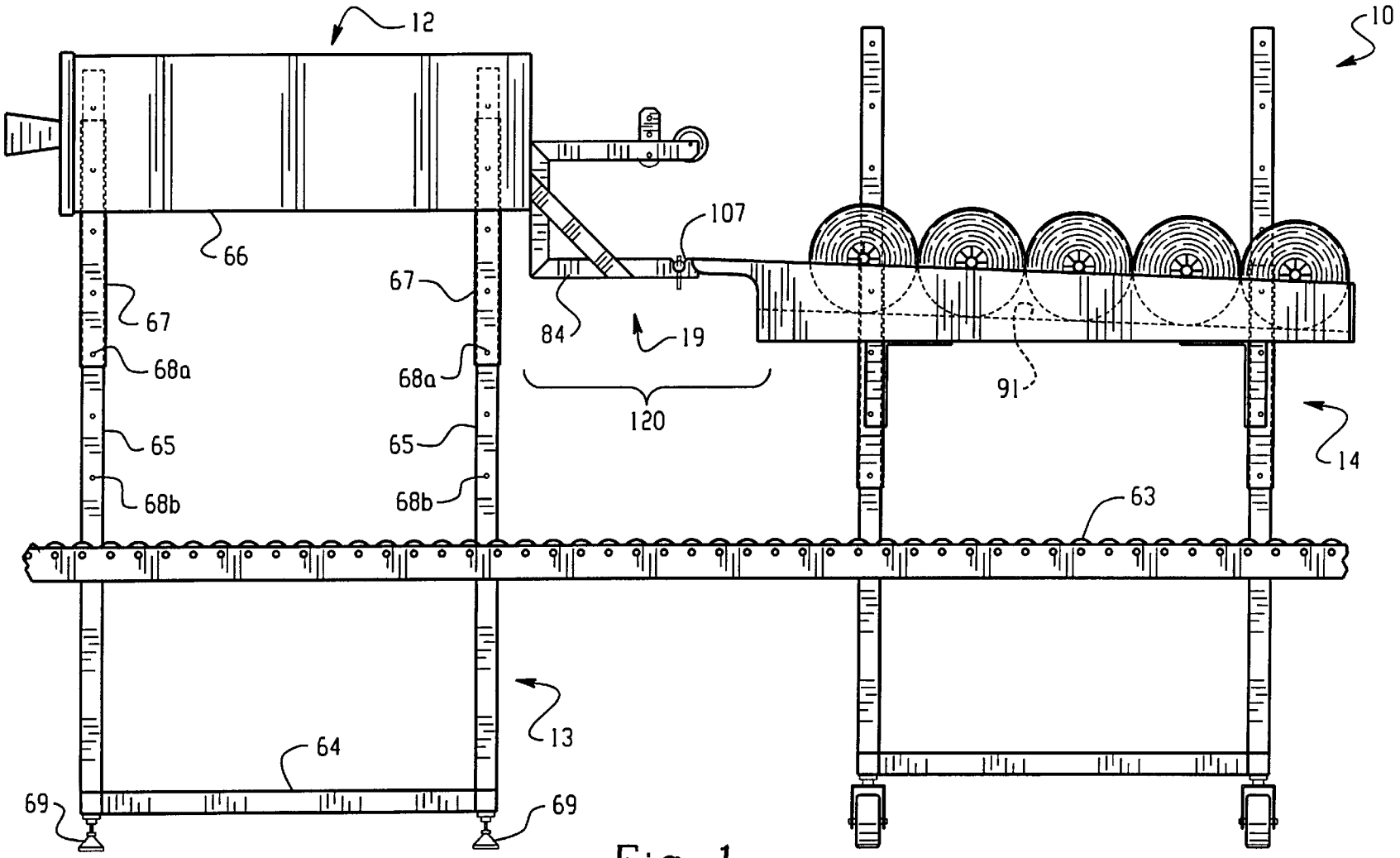
FIG. 1 is a side elevational view of a cushioning conversion system according to the present invention.

Referring now to the drawings in detail and initially to FIG. 1, a preferred embodiment of a cushioning conversion system 10 according to the present invention is shown. The system 10 generally comprises a cushioning conversion machine 12 for producing dunnage pads from sheet stock material, a stand 13 for supporting the machine 12, and a stock roll storage rack 14 for supporting at least one and preferably a plurality of rolls of sheet stock material that is to be converted by the conversion machine into a relatively low density cushioning dunnage product or pad.

Figure 2:
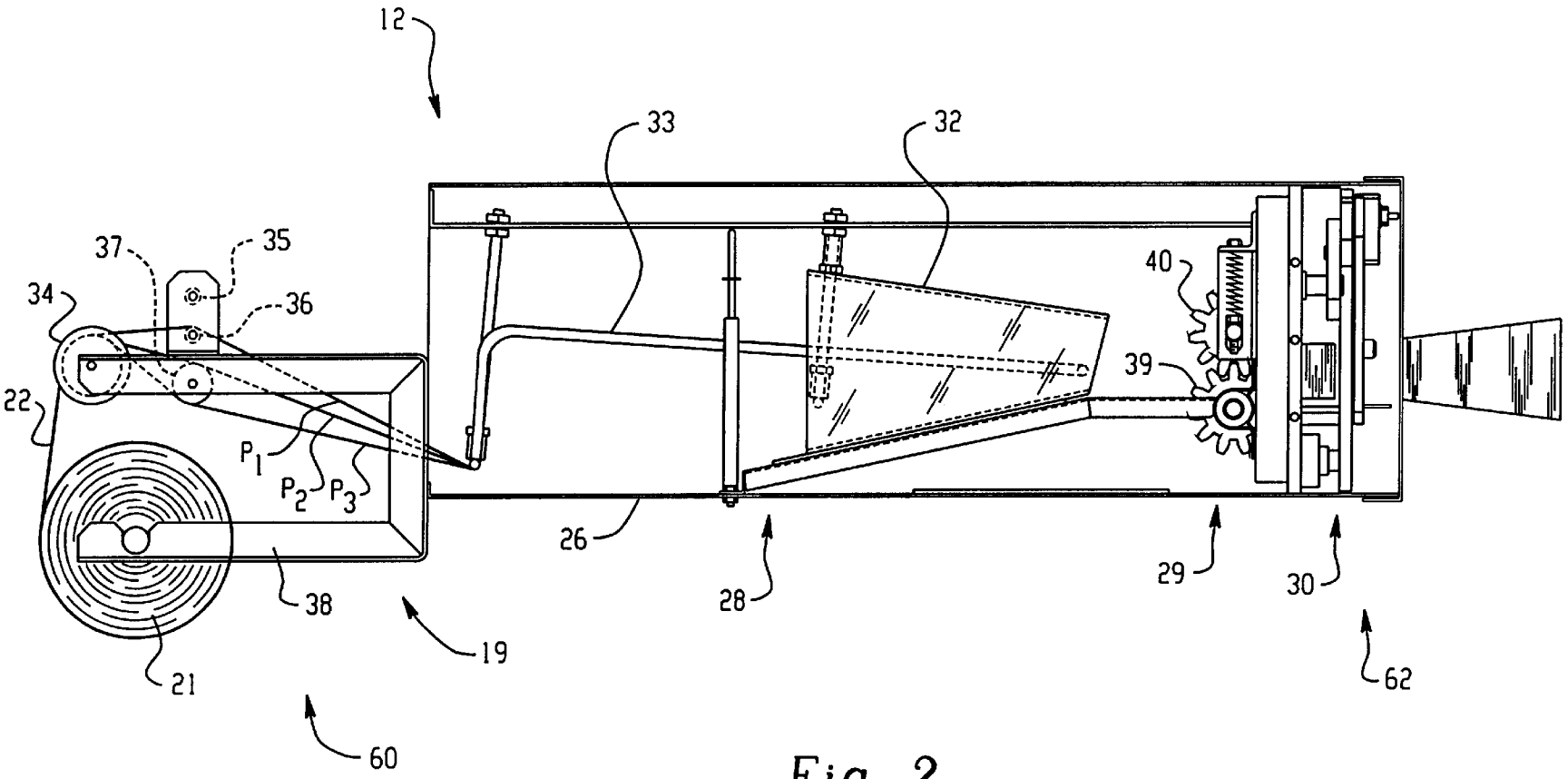
FIG. 2 is a side elevational view of a cushioning conversion machine which may be used in the system according to the present invention, with the nearest wall of the machine's housing removed to show the conversion assemblies therein.

As shown in FIGS. 1 and 2, the conversion machine 12 includes a stock roll holder 19 for supporting a stock roll 21 (see FIG. 2) of sheet stock material 22. The stock material 22 preferably consists of one or more, typically two or three, superimposed lies $P_1$, $P_2$, and $P_3$ of biodegradable, recyclable and reusable sheet material, such as Kraft paper rolled onto a hollow cylindrical tube, though which a spindle 99 is inserted. The machine 12 converts this stock materials 22 into a crumpled strip of cushioning/dunnage (not shown) having inwardly folded edge portions interconnected to maintain the cushioning integrity of the cushioning strip. The machine 12 also has provision for severing, as by cutting, the strip to form a discrete pad of desired length, as is further discussed below.

The machine 12 generally comprises a housing 26 and cushion-producing (conversion) assemblies which are mounted in the housing 26 and which form the pads. The cushion-producing assemblies of the illustrated conversion machine include a forming assembly 28, a feeding/connecting assembly 29, and a severing assembly 30, all of which are mounted in or to the housing 26. The illustrated forming assembly 28 includes a shaping chute 32 and a forming member 33 for forming the sheet material into a relatively thicker three-dimensional strip that is then connected by the feeding/connecting assembly 29 to form the cushioning strip that is cut to length by the severing assembly 30.

During operation of the machine 12, the stock material 22 is payed off of the stock roll 21 and travels over a constant entry roller 34. After passage over the constant entry roller, the plies $P_1$, $P_2$ and $P_3$ are separated for passage between or around separators 35–37. The constant entry roller and separators are mounted between brackets 38 attached to the rear end of the housing 26. For further details of the constant entry roller and separators, reference may be had to U.S. Pat. No. 5,123,889. In the illustrated embodiment, the brackets 38 are U-shaped with the base thereof attached to the machine housing, the upper legs thereof supporting the constant entry roller 34 and separators 35, 36 and 37 and the lower legs thereof forming the stock roll holder 19.

From the separators 35–37, the separated plies $P_1$, $P_2$ and $P_3$ pass to the forming assembly 28. The forming assembly 28 causes inward folding of the lateral edges of the sheet stock material 22 to form a continuous strip having lateral pillow portions and a thinner central band portion. The feeding/connecting assembly 29, which in the illustrated embodiment includes a pair of cooperating gear-like members 39 and 40, pulls the stock material 22 downstream through the machine and also connects the layers along the central band, as by coining and/or perforating in the illustrated preferred embodiment, to form a connected strip. As the connected cushioning strip travels downstream from the feed assembly 29, the severing assembly 30 cuts the strip into pads of a desired length. For further details of the illustrated and similar cushion-producing machines, reference may be had to U.S. Pat. No. 5,123,889 and published PCT application No. US96/09109.

Figure 10:
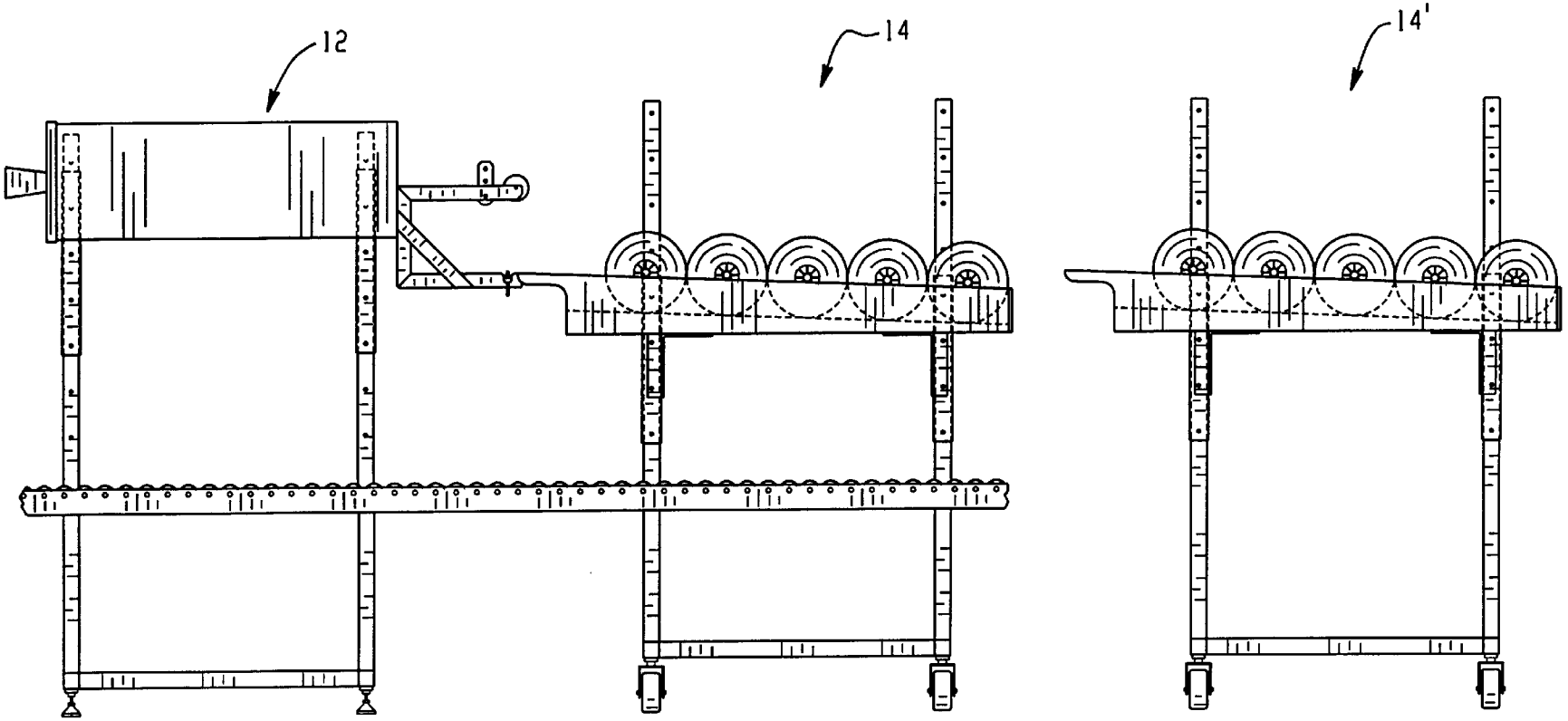
FIG. 10 is a view of a cushioning conversion system including plural stock roll storage racks, one of which is shown being used to load stock rolls onto a cushioning conversion machine.

The production of dunnage pads by the illustrated machine 12 is controlled by a controller (not shown) usually provided in the housing 26 or in a remote unit FIG. 10 is a view of a cushioning conversion system including plural stock roll storage racks, one of which is shown being used to load stock rolls onto a cushioning conversion machine. For details of the operation of the controller, reference may be had to U.S. Pat. Nos. 4,619,635 and 5,571,067 and to published PCT application No. PCT/US95/09275, which are hereby incorporated herein by reference in their entireties.

An exemplary pad produced by the illustrated machine 12 comprises the one or more plies of sheet material that have side portions thereof folded over the center portions thereof to form laterally spaced-apart pillow portions extending along the length of the pad. The pillow portions are separated by a central band where lateral edge portions are brought together. The lateral edge portions, which may be overlapped and/or interleaved, are connected together, and/or to underlying center portions of the plies along the central band. In a preferred form of cushioning pad, the connecting is accomplished by a combination of coining and stitching, the stitching being effected by perforations and/or cut tabs disposed along the central band. However, it will be appreciated by those skilled in the art that other types of conversion machine may be used to produce the same or other forms of cushioning strips. For further details of an exemplary pad, reference may be had to published PCT application No. US96/09109, which is hereby incorporated herein by reference in its entirety.

The housing 26 of the conversion machine 12 has a longitudinal axis corresponding to the direction of passage of the sheet material downstream through the conversion assemblies from a rear or upstream end 60 to a front or downstream end 62 of the machine. The housing is generally rectangular in cross-section taken transverse to the longitudinal axis of the machine. The machine 12 may be supported in any suitable manner, for example by the stand 13.

As best illustrated in FIG. 1, the cushioning conversion machine 12 may be adjustably supported at a convenient height by the stand 13. The stand may be of any suitable type for any given application. However, a preferred form of stand is illustrated and below described for use in relation to a conveyor 63.

The stand 13 includes a base frame 64 and tubular posts or uprights 65 extending upwardly from one side of the base frame 64. The machine 12 is mounted to the uprights 65 in a cantilever-like fashion so that the machine can be located over the conveyor 63 to minimize the floor space occupied by the machine and stand assembly while providing for convenient delivery of the cushioning/dunnage pads at a location above the conveyor for use in packaging articles carried by the conveyor and/or in container, e.g., boxes, carried on the conveyor. As is preferred, the machine 12 is secured by brackets 66 to tubular slides 67 which are telescopically movable along the uprights 65 so that the height of the machine can be varied as desired. The slides 67 and uprights 65 include respective holes 68*a* and 68*b* which are alignable at different machine height positions for receiving locking pins (not shown) which, when inserted into the aligned holes, maintain the adjusted height position of the conversion machine. If desired, the base frame 64 may be equipped with wheels, e.g., casters (not shown), for moving the machine and stand assembly from one location to another. In the illustrated stand, adjustable feet 69 are provided for leveling the machine. For details of other frame and machine mounting arrangements, reference may had to U.S. Pat. No. 5,123,889 and U.S. patent application Ser. No. 08/194,143, both of which are hereby incorporated herein by reference in their entireties.

Figure 3:
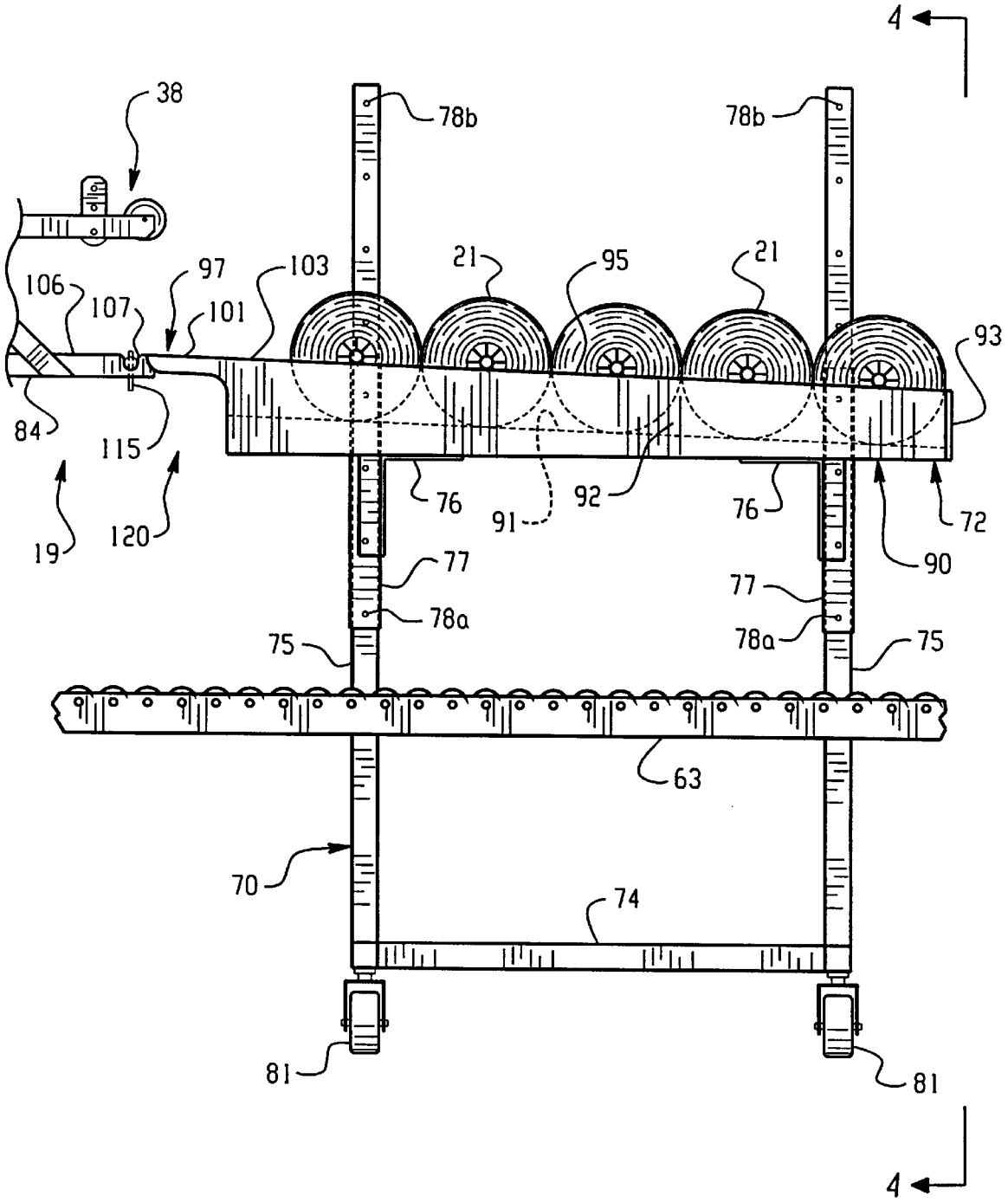
FIG. 3 is an enlarged side elevational view of a stock roll storage rack used in the system shown in FIG. 1.
Figure 4:
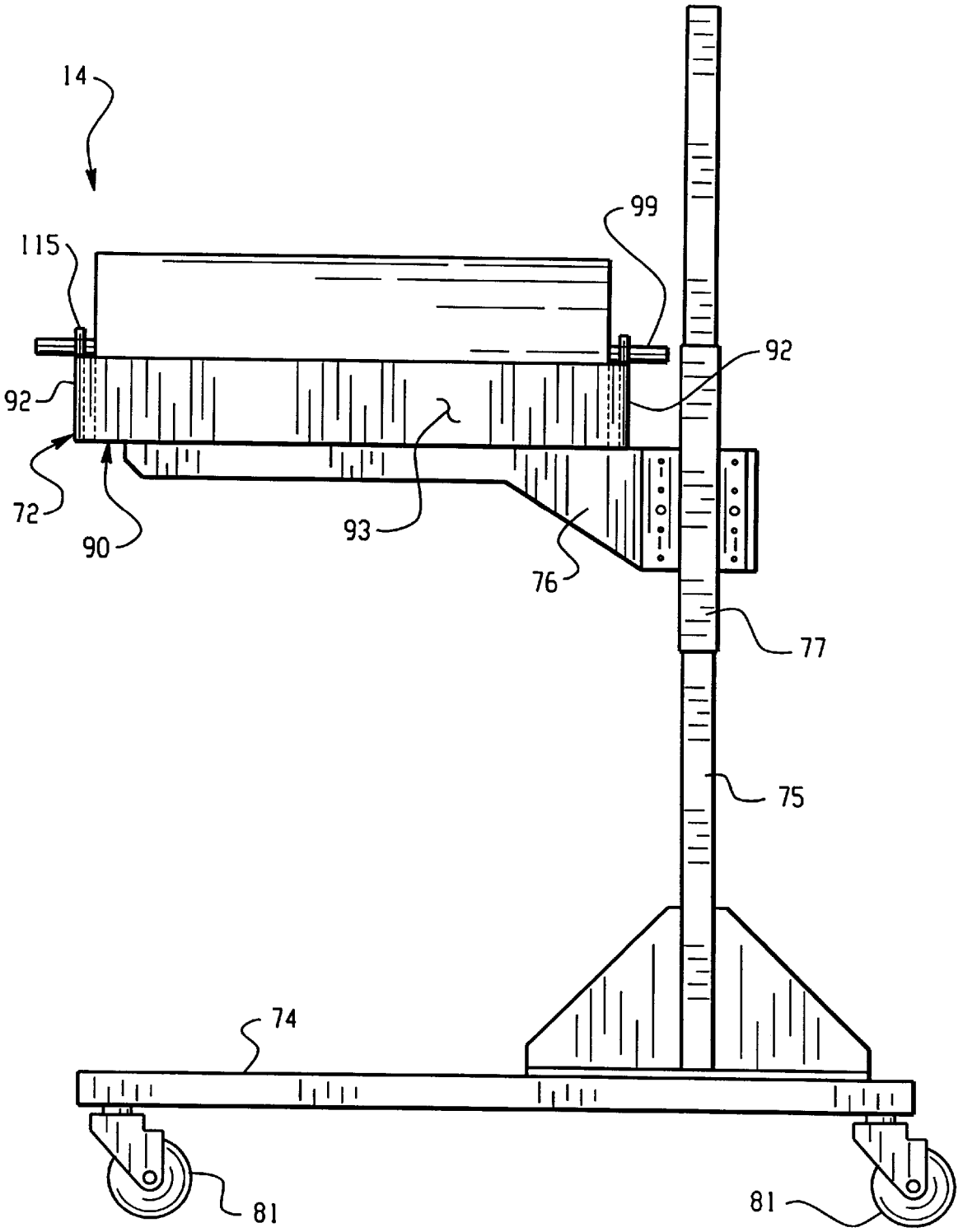
FIG. 4 is a rear elevational view of the stock roll storage rack shown in FIG. 3, looking from the line 4—4 of FIG. 3.

Referring now to FIGS. 3 and 4, a preferred embodiment of the stock roll storage rack 14 includes a stand 70 and a stock roll support shelf 72 mounted to the stand. The stand 70 may be of any suitable type for any given application. However, a preferred form of stand is illustrated and below described for use in relation to the conveyor 63 and in association with the cantilevered-supported conversion machine 12.

The illustrated preferred embodiment of stand 70 is similar to the stand 13. The stand 70 includes a base frame 74 and tubular posts or uprights 75 extending upwardly from one side of the base frame 74. The storage shelf 72 is mounted to the uprights 75 in a cantilever-like fashion so that the shelf can be located over the conveyor 63 to enable loading of the machine with a stock roll in the hereinafter described manner. As is preferred, the storage shelf 72 is secured by brackets 76 to tubular slides 77 which are telescopically movable along the uprights 75 so that the height of the machine can be varied as desired. The slides 77 and uprights 75 include respective holes 78*a* and 78*b* which are alignable at different storage shelf height positions for receiving locking pins which, when inserted into the aligned holes, maintain the adjusted height position of the storage shelf. Preferably, the arrangement of the alignment holes 78*a* and 78*b* in the slides 77 and uprights 75 correspond to respective alignment holes 68*a* and 68*b* in the slides 67 and uprights 65 (FIG. 1) so that the conversion machine and storage shelf can be adjustably positioned at the same level for proper loading of stock rolls onto the stock roll holder 19.

As is preferred, the base frame 74 of the stand 70 may be equipped with wheels, e.g., casters 81, for moving the storage rack 14 from one location to another. This enables the storage rack to be filled with stock rolls at a remote site and then rolled into position adjacent a conversion machine to be serviced with the stock rolls carried by the storage rack. Also, multiple storage racks may be used so that while one is positioned to supply stock rolls to the conversion machine, another storage rack can be filled at a remote site and transported back to the conversion machine so that it is ready for use when the other storage rack becomes empty. Preferably, at least one pair of wheels on the storage rack are pivotable about a generally vertical axis to facilitate maneuvering of the rack. As is also preferred, a brake (not shown) may be provided, as in association with one or more of the wheels, to prevent rolling of the storage rack when desired, as when positioned to load stock rolls onto the stock roll holder 19 of the conversion machine 12 (FIG. 1) from the storage shelf 72.

The storage shelf 72 is configured to store at least one and preferably a plurality of stock rolls 21 for sequential loading onto the stock roller holder 19. The stock rolls preferably are supported by the storage shelf 72 at about the same vertical height as a stock roll is supported by the lower legs of the brackets 38 (FIG. 2), which lower legs form spindle supports 84 of the stock roll holder 19 in the illustrated system. The storage shelf has provision for transferring a stock roll therefrom and onto the stock roller holder with minimal effort on the part of an operator.

In the illustrated preferred embodiment, the storage shelf 72 includes a tray 90 supported on the brackets 76. The tray 90 includes a bottom wall 91, side walls 92 and a rear wall 93. As is preferred, the bottom wall 91 is sloped to form a slightly inclined ramp and thus cause stock rolls 21 supported thereon to roll by gravity against the rear wall 93 which functions as an abutment or stop for a generally horizontal stack of storage rolls supported on the bottom wall. The front end of the tray, opposite the rear wall 93, has an exit passage for allowing the stock rolls to roll off the forward or upper end of the bottom wall.

The side walls 92 function to limit lateral (axial) shifting movement of the stock rolls 21 supported on the bottom wall 91 of the tray 90. The side walls also have inclined top surfaces 95 which preferably extend parallel to the bottom wall 91. The height of the side walls preferably is selected to permit insertion of a stock roll support spindle through the center of the stock rolls supported on the bottom wall preferably at each storage position of the stock rolls.

At the front end of the storage shelf 72 there is provided a loading ramp 97 for enabling a transfer of a stock roll 21 from the storage tray 90 to the stock roller holder 19. As seen in FIG. 3, the loading ramp 97 can be positioned in overlapping relation with the laterally spaced apart spindle supports 84 of the stock roll holder 19, and the stock roll transfer can be effected by rolling the leading (forwardmost) stock roll forwardly along and up the slight incline of the bottom wall 91 until the stock roll moves off the forward end of the bottom wall. Before or as the stock roll moves off the forward end of the bottom wall, the ends of the spindle 99 that had previously been inserted into the core of the stock roll will be disposed above or on the loading ramp 97. As the stock roll moves off the forward end of the bottom wall, the ends of the spindle 99 will be supported on the loading ramp. Further forward movement of the stock roll will cause the spindle to roll and/or slide along the loading ramp for deposit onto the laterally spaced apart spindle supports 84 of stock roll holder 19.

In the illustrated preferred embodiment of the storage rack 14, the loading ramp 97 is formed by a pair of rails 101 that project forwardly from the side walls 92 of the storage tray 90 and beyond the exit passage of the tray. The rails 101 are parallel and laterally spaced apart to permit passage therebetween of the stock roll 21 supported on the spindle 99. The rails also are dimensioned to fit between and in overlapping relation with the rear end portions of the spindle supports 84 of the stock roll holder 19 as shown in FIG. 3. The rails preferably are formed integrally with the side walls of the storage tray and the top surfaces 103 of the rails preferably form continuations of the top surfaces 95 of the respective side walls. Preferably, the top ramp surfaces 103 of the rails are inclined at the same angle as the bottom wall 91 of the storage tray so that if the stock roller is ever released by the operator during a loading operation, it will roll smoothly back to its original storage position, unless the stock roll spindle ends have already passed onto the top surfaces 106 of the spindle supports 84 or into capture recesses 107, e.g. slots, in the spindle supports 84.

Figure 5:
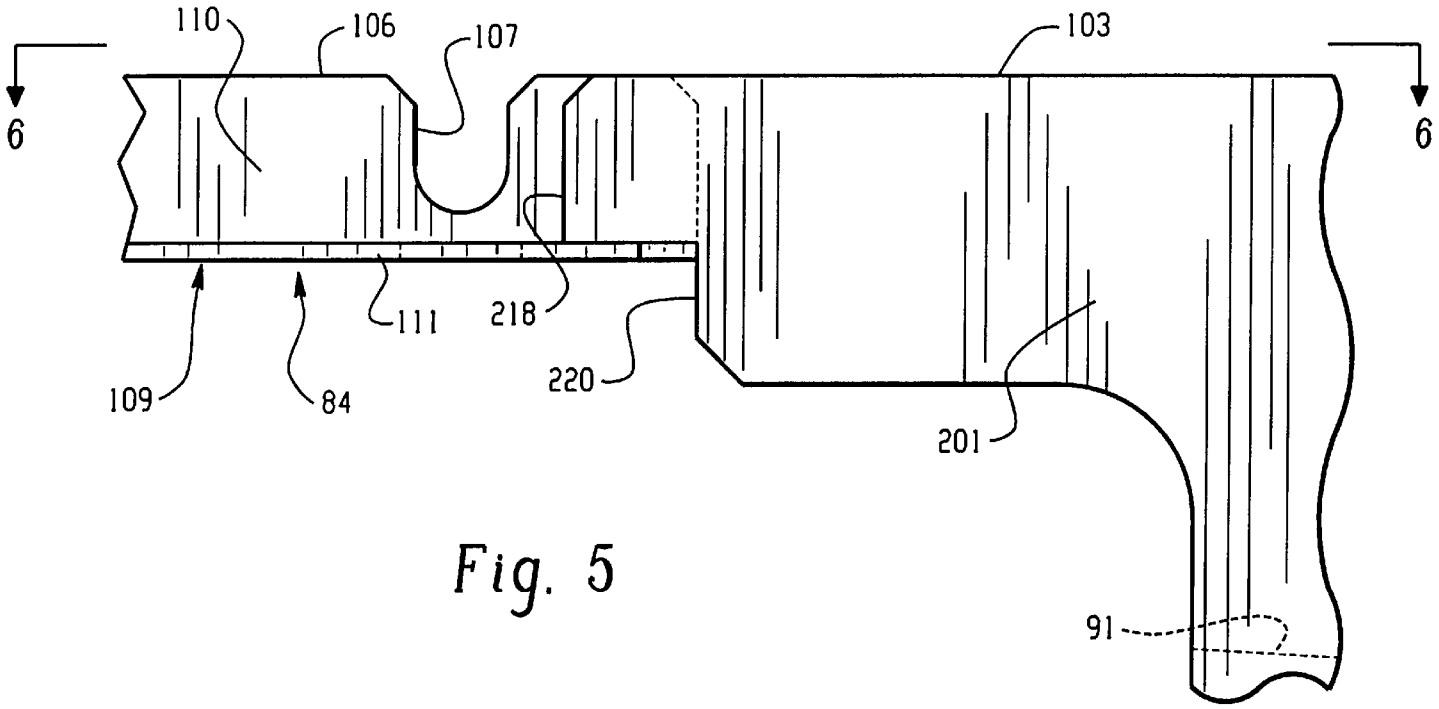
FIG. 5 is an enlarged fragmentary side elevational view showing the machine's stock roll holder and the stock roll storage rack with a modified loading ramp.
Figure 6:
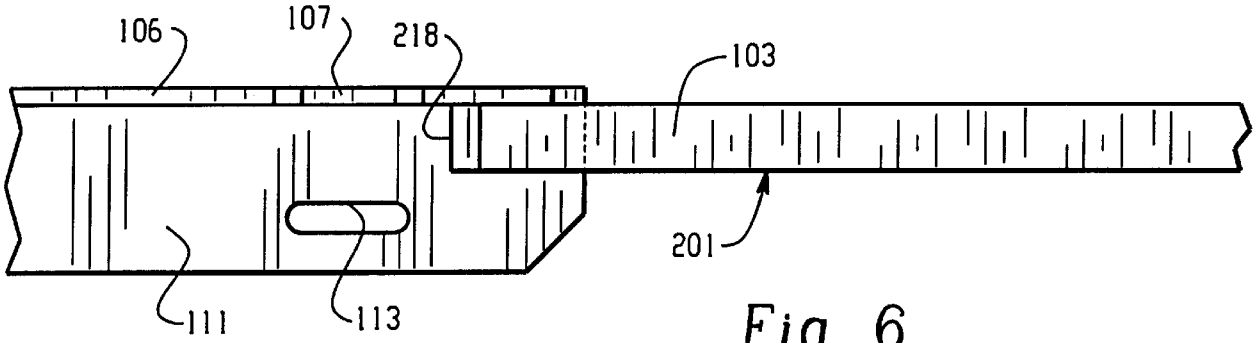
FIG. 6 is a fragmentary plan view looking from the line 6—6 of FIG. 5.

As shown in FIGS. 5 and 6, each spindle support 84 may be formed by an angle member 109 having formed in its upright leg 110 the recess 107 for closely receiving a corresponding end of the spindle 99. The lower leg 111 of the angle member 109 has formed therein an opening or aperture 113 to receive the end of a pin 115 (FIGS. 3 and 4) to prevent the spindle from rotating relative to the spindle supports 84. (It is noted, however, that other means may be employed to prevent rotation of the spindle member relative to the mount.) As shown in FIG. 5, the recess 107 in the upright leg 110 of the angle member 109 may have a wide tapered mouth to facilitate guiding of the spindle member into the relatively narrow lower portion of the recess which closely cradles the spindle against horizontal movement perpendicular to the longitudinal extent or axis of the spindle member.

With the cushioning conversion system 10, a plurality of stock rolls 21 are preferably stored on the stock roll storage rack 14 and the stock roll storage rack 14 is positioned adjacent the stock roll holder 19 of the cushioning conversion machine 12. The spindle 99 is then placed through the leading stock roll 21 (or, in other words, the stock roll 21 closest to the stock roll holder 19) whereby the ends of the spindle 99 extend laterally beyond the side walls 92 of the tray 90 and the spindle supports 84. The stock roll 21 is then pushed so that it rolls up the loading ramp 97, its weight being supported by the tray's bottom wall 91. Once the pushed stock roll 21 reaches the end of the bottom wall 91, it passes into a transition region 120. In this transition region 120, the weight of the stock roll 21 is supported by the ends of the spindle 99 resting on the rail top surfaces 103 and the top surfaces 106 of the spindle supports 84.

Thus, in the cushioning conversion system 10, the stock roll storage rack 14 is used to support at least one and preferably a plurality of stock rolls 21 at the same level as the stock roll holder 19 of the cushioning conversion machine 12. This enables an operator to easily load the machine 12 without having to lift the stock roll to the height of the stock roll holder and/or without having to wait for an attendant to lift and load a stock roll on the machine. Also, as shown in FIG. 10, plural stock roll storage racks 14 and 14' can be used interchangeably, whereby one can be loaded with stock rolls by an attendant while the other is used to load stock rolls onto the cushioning conversion machine.

A modified loading rail 201 is shown in FIGS. 5 and 6. This loading rail 201 has at the front end thereof a nose portion 218 configured to interfit with the rear end portion of the corresponding angle member 109. The nose portion 218 has a height about equal the height of the upright leg 110 (or wall) of the angle member. This height is sufficient to allow the anti-rotation pin 115 (FIG. 3), which typically is fixed to the spindle, to clear the bottom leg 111 (or wall) of the angle member as the end of the spindle member is rolled along the angle member. Also, the nose portion 218 projects from a shoulder surface 220 on the rails 201 a distance less than the distance between the recess 107 and the end of the angle member 109 to prevent over-insertion of the loading rail 201 relative to the stock roll holder 19. Abutment of the shoulder surface 220 against the end of the angle member (spindle support) provides a positive location stop for proper longitudinal positioning of the loading rails 201 relative to the spindle supports 84 of the stock roll holder 19. Also, the spacing between the inner side surfaces of the loading rails 201 preferably is about equal or slightly larger than the spacing between the outer surfaces of the upright legs 110. This will ensure proper lateral positioning between the loading rails 201 and the spindle supports 84. Thus, when the storage rack 14 includes the modified loading rails 201, the cushioning conversion machine 12 and the storage rack 14 include cooperating interengageable locating devices for removably positioning the storage rack 14 in relation to the machine 12.

Figure 7:
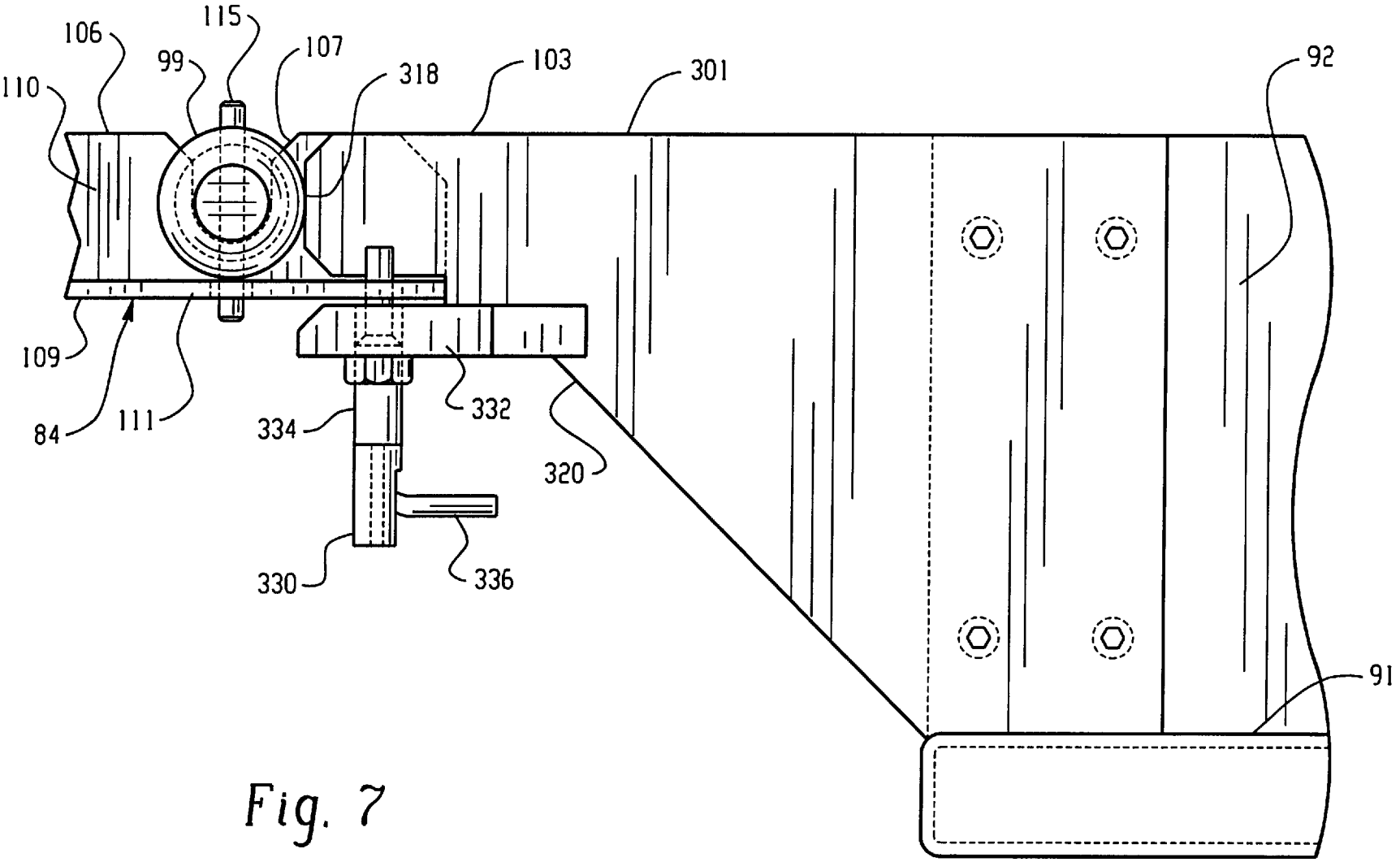
FIG. 7 is an enlarged fragmentary side elevational view showing the machine's stock roll holder and the stock roll storage rack with another modified loading ramp, together with a locking device for selectively locking the storage rack in relation to the machine.

Another modified loading rail 301 is shown in FIG. 7. While the rails 101 and 201 are preferably are formed integrally with the tray's side walls 92 of the storage tray 90, the rails 301 are preferably separate pieces attached to the tray's side walls 92 by, for example, bolts. The loading rail 301 has at the front end thereof a nose portion 318, similar to the nose portion 218, configured to interfit with the rear end portion of the corresponding angle member 109. The nose portion 318 projects from a shoulder surface 320 and abutment of the shoulder surface 320 against the end of the angle member (spindle support) provides a positive location stop for proper longitudinal positioning of the loading rails 304 relative to the spindle supports 84 of the stock roll holder 19.

Thus, when the storage rack 14 includes the modified loading rails 301, the cushioning conversion machine 12 and the storage rack 14 include cooperating interengageable locating devices for removably positioning the storage rack 14 in relation to the machine 12. Additionally, one or both of the modified rails 301 includes a locking device 330 which locks the rails 301 to the bottom leg 111 thereby locking the stock roll storage rack 14 to the stock roll holder 19 of the cushioning conversion machine 12. The illustrated locking device 330 includes a mounting flange 332 which is attached to the shoulder 320 of the rail 301 and situates a fastener 334 for selective insertion through an opening in the bottom leg 111 of the angle arm 109. When positioning the stock roll storage rack 14 with respect to a cushioning conversion machine 20, the fastener 334 is withdrawn so that its upper end is lowered to be at least flush with the top surface of the mounting flange 332. The shoulder surface 320 is then abutted against the against the end of the angle member (spindle support) to provide proper longitudinal positioning of the loading rails 301 relative to the spindle supports 84 of the stock roll holder 19. The fastener 334 is then extended so that passes through the opening in the stock roll holder bottom leg 111 to lock the storage rack 14 in position.

When the storage rack 14 is to be removed (for example, to be refilled with stock rolls at remote location and/or to be replaced with a previously replenished storage rack), the fastener 334 is once again withdrawn. In the illustrated embodiment, the fastener 334 is a spring plunger which may be retracted (via a lever 336) for initial positioning and removal of the stock roll storage rack 14, and released for locking the stock roll storage rack 14 in position relative to the cushioning conversion machine 10. It may be noted that the locking device(s) 330 and the cooperating opening the spindle support(s) 84 may also function as cooperating interengageable locating devices for removably positioning the storage rack 14 in relation to the machine 12, in addition to, or independently of, the geometry of the rails 301 (i.e., the shape of its nose portion 318 and/or shoulder portion 320) and the stock roll holder 19.

Figure 8:
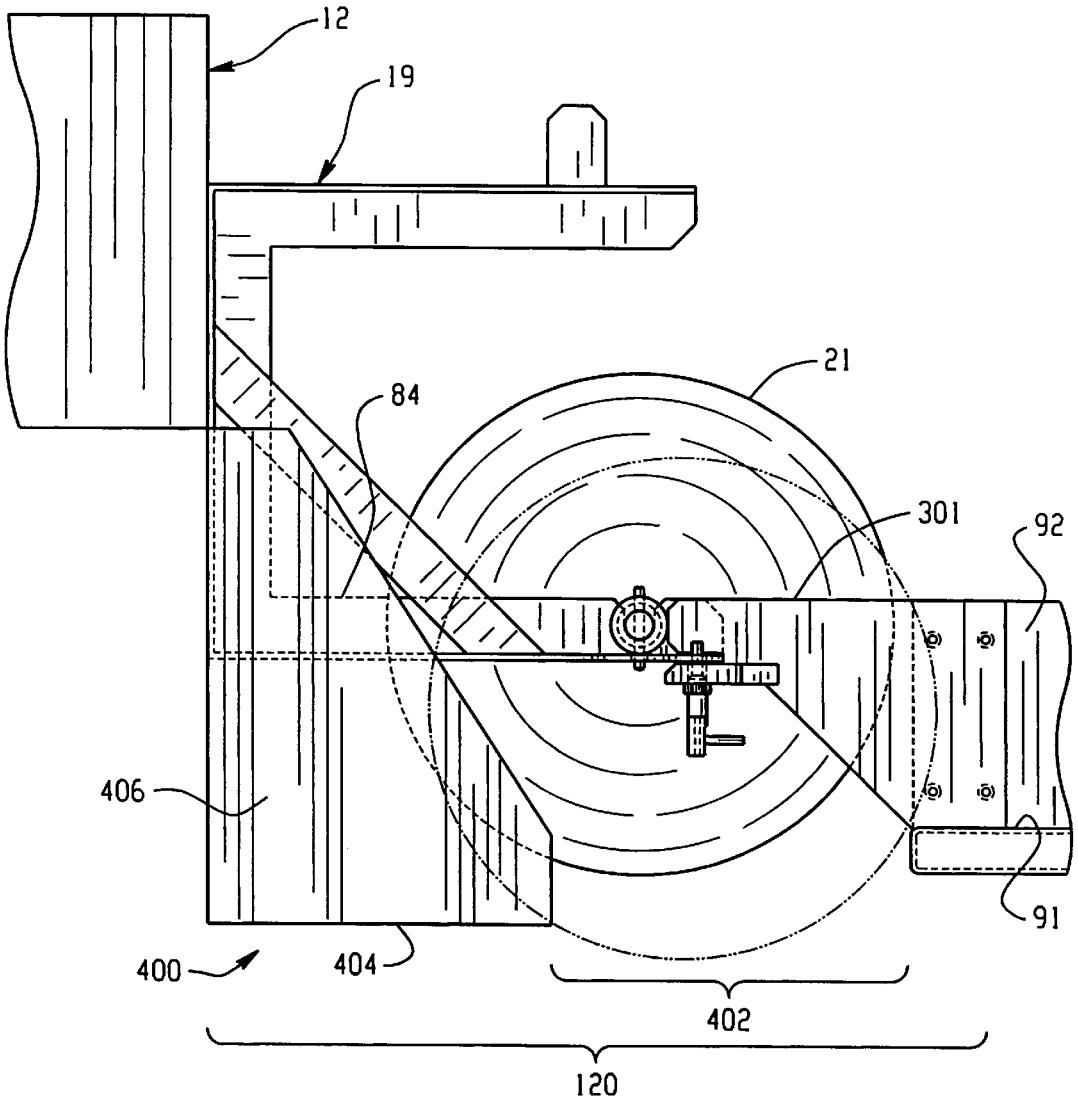
FIG. 8 is an enlarged fragmentary side elavational view showing an upstream portion of the cushioning conversion machine, the modified loading ramp of FIG. 7, and a catching device which may be used with the cushioning conversion system.

As was indicated above, in the transition space 120 between the end of the tray's bottom wall 91 and the stock roll capture recesses 107, the weight of the stock roll 21 is supported by the ends of the spindle 99 resting on the rail top surfaces 103 and/or the top surfaces 106 of the spindle supports 106. Thus, if the spindle 99 is inadvertently not inserted into the stock roll 21 prior to it reaching the transition region, the stock roll 21 will fall from the stock roll storage rack 14 once it reaches the transition region 120. If desired, a catching device 400, such as is shown in FIG. 8, may be incorporated into the cushioning conversion system 10, to protect against a spindle-less stock roll 21 (shown in dashed lines) from falling through the transition region 120.

In the illustrated embodiment, the catching device 400 and the bottom wall 91 of the tray 90 together define a window 402 in the transition region 120. Specifically, the upstream edge of a bottom wall 404 of the catching device 400 forms the downstream edge of the window and the downstream edge of the tray bottom wall 91 forms the upstream edge of the window 402. In any event, the span of the window 402 is less than the diameter of the stock roll 21 whereby a spindle-less stock roll 21 will not fall therethrough. Accordingly, the spindle-less stock roll 21 is caught in the window 402 and must only be lifted a slight distance for insertion of the spindle 99 and positioning of the spindle 99 within the cradling recesses 107.

In the illustrated embodiment, the catching device 400 includes, in addition to the bottom wall 404, a pair of side plates 406 each having a roughly right triangular shape. The upper portions of the vertical downstream sides of the plates 406 are attached to the brackets 38. The lower horizontal sides of the plates 406 are positioned below the stock roll holder 19, at approximately the same level as the downstream edge of the tray bottom wall 90. The bottom wall 404 extends between the lower horizontal sides of the triangular plates 406 thereby positioning it at approximately the same level as the downstream edge of the tray bottom wall 90.

Figure 9:
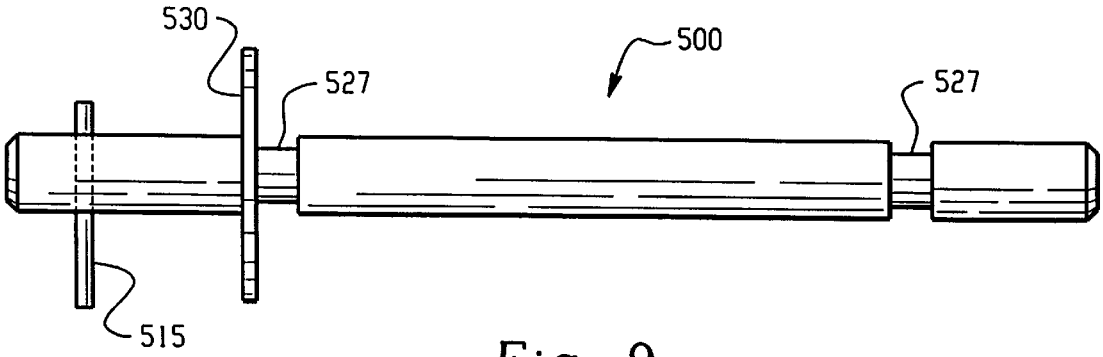
FIG. 9 is a side elevational view of a modified stock roll spindle according to the present invention.

Referring now to FIG. 9, a stock roll spindle 500 is illustrated which is especially adapted for use with the stock roll storage rack 14, regardless of whether it includes rails 101, 201 or 301 and/or the catching device 400. The stock roll spindle 500 has formed therein annular grooves 527 laterally spaced apart the same distance as between the loading rails 101, 201 or 301. When the spindle ends are supported on the loading rails, the top edges of the rails will be captured in the grooves to prevent lateral shifting movement of the spindle during loading of a stock roll. Also, the spindle 500 may be provided at one end thereof an anti-rotation pin 115 (of the same design, and having the same purpose, as the anti-rotation discussed above) and a stop flange 530. The purpose of the stop flange 530 is to determine the extent of insertion of the spindle into the stock roll so that the grooves will both be located outside the stock roll and properly positioned relative to the side walls of the storage tray and more particularly the loading rails.

Although the invention has been shown and described with respect to certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention.

What is claimed is:

1. A cushioning conversion system for converting sheet stock material into a relatively low density cushioning dunnage product, comprising a cushioning conversion machine and a stock roll storage rack;

the cushioning conversion machine including conversion assemblies which convert the sheet stock material into the cushioning dunnage product and a stock roll holder for supporting a roll of sheet stock material for rotation so that the sheet stock material can be payed out to said conversion assemblies for conversion into a cushioning dunnage product; and the stock roll storage rack being positioned adjacent said stock roll holder and configured to support a stock roll at the same level as said stock roll holder for loading the stock rolls onto said stock roll holder.

2. A system as set forth in claim 1, wherein said stock roll holder includes a pair of laterally spaced apart stock roll supports for supporting the ends of a spindle on which the stock roll can be supported for rotation and paying out of stock material to said conversion assemblies; and wherein said stock roll storage rack has a loading ramp at the same level as said stock roll supports, and said loading ramp includes a pair of laterally spaced apart ramp surfaces over which the ends of a stock roll spindle can pass for loading the stock roll onto said stock roll supports.

3. A system as set forth in claim 1, wherein said conversion machine is mounted on a stand for vertical adjustment between a plurality of different heights, and said stock roll storage rack includes a stand and a stock roll storage shelf mounted to said stand for vertical adjustment between a plurality of different heights.

4. A system as set forth in claim 1, wherein said conversion machine and stock roll storage shelf are both cantilevered to one side of their respective stands.

5. A system as set forth in claim 1, wherein said conversion machine and storage rack include cooperating interengageable locating devices for removably positioning said storage rack in relation to said conversion machine for loading a stock roll on said machine.

6. A system as set forth in claim 5, wherein said locating devices comprise a nose portion on a loading rail of the storage rack which is configured to interfit with an end portion of an angle member of the stock roll holder.

7. A system as set forth in claim 1, further comprising a spindle for supporting a stock roll; wherein said stock roll holder includes a pair of laterally spaced apart stock roll supports for supporting the ends of the spindle on which the stock roll is supported for rotation and paying out of stock material to said conversion assemblies; wherein said stock roll storage rack includes a pair of laterally spaced apart rails for supporting the ends of the spindle as a stock roll is being transferred from said stock roll storage rack to said stock roll holder; and wherein said spindle has a pair of annular grooves in which said rails are engageable, respectively, for limiting lateral shifting movement of said spindle relative to said rails.

8. A system as set forth in claim 7, wherein said spindle has adjacent one end thereof a stop collar for preventing over-insertion of said spindle into a stock roll.

9. A system as set forth in claim 1, comprising a second stock roll storage rack, and wherein said stock roll storage racks are interchangeable with one another.

10. A system as set forth in claim 1, wherein said stock roll storage rack is inclined to horizontal for causing stock rolls supported thereon to roll by gravity in a direction away from the cushioning conversion machine.

11. A system as set forth in claim 10, wherein the stock roll storage rack includes a wall for preventing a generally horizontal stack of stock rolls supported on the bottom wall from rolling off said inclined storage rack.

12. A cushioning conversion system for converting sheet stock material into a relatively low density cushioning dunnage product, comprising a cushioning conversion machine and a stock roll storage rack;

the cushioning conversion machine including conversion assemblies which convert the sheet stock material into the cushioning dunnage product and a stock roll holder for supporting a roll of sheet stock material for rotation so that the sheet stock material can be payed out to said conversion assemblies for conversion into a cushioning dunnage product; and the stock roll storage rack being positioned adjacent said stock roll holder and configured to support a stock roll at the same level as said stock roll holder for loading the stock rolls onto said stock roll holder;

wherein said stock roll storage rack includes a tray having a bottom wall for supporting a plurality of stock rolls in a generally horizontal array for sequential loading onto said stock roll holder.

13. A system as set forth in claim 12, wherein said bottom wall is inclined to horizontal.

14. A system as set forth in claim 13, wherein said tray further includes an abutment at a rear end of said bottom wall and an exit passage at the forward end of the bottom wall; and said bottom wall is inclined to horizontal in a direction that causes the stock rolls supported thereon to roll rearwardly toward and against said abutment, whereby a leading one of the stock rolls must be rolled up a slight incline for loading onto said stock roll holder of said conversion machine.

15. A cushioning conversion system for converting sheet stock material into a relatively low density cushioning dunnage product, comprising a cushioning conversion machine and a stock roll storage rack:

the cushioning conversion machine including conversion assemblies which convert the sheet stock material into the cushioning dunnage product and a stock roll holder for supporting a roll of sheet stock material for rotation so that the sheet stock material can be payed out to said conversion assemblies for conversion into a cushioning dunnage product; and the stock roll storage rack being positioned adjacent said stock roll holder and configured to support a stock roll at the same level as said stock roll holder for loading the stock rolls onto said stock roll holder;

wherein said system includes a locking device for selectively locking said storage rack in relation to said conversion machine for loading a stock roll on said machine.

16. A system as set forth in claim 15, wherein the locking device includes a fastener mounted to the storage rack for selective insertion through an opening in stock roll holder.

17. A cushioning conversion system for converting sheet stock material into a relatively low density cushioning dunnage product, comprising a cushioning conversion machine and a stock roll storage rack;

the cushioning conversion machine including conversion assemblies which convert the sheet stock material into the cushioning dunnage product and a stock roll holder for supporting a roll of sheet stock material for rotation so that the sheet stock material can be paved out to said conversion assemblies for conversion into a cushioning dunnage product;

the stock roll storage rack being positioned adjacent said stock roll holder and configured to support a stock roll at the same level as said stock roll holder for loading the stock rolls onto said stock roll holder; and wherein said system includes a catching device which at least partially defines a window in a transition region downstream of said stock roll storage rack, said window being dimensioned to prevent the passage of a stock roll therethrough.

18. A system as set forth in claim 17, wherein the stock roll storage rack includes a bottom wall having an downstream edge defining the upstream end of the window and the catching device includes a bottom wall having an upstream edge defining the downstream end of the window.

19. A method of loading a roll of sheet stock material onto a stock roll holder which supports the stock roll for rotation so that the sheet stock material can be payed out to conversion assemblies for conversion into a relatively lower density cushioning dunnage product, said method comprising the steps of:

storing at least one stock roll on a stock roll storage rack positioned adjacent the stock roll holder and configured to support the stock roll at the same level as the stock roll holder; and moving the stock roll along a loading ramp and onto the stock roll holder.

20. A method as set forth in claim 19, further comprising the step of converting the sheet stock material to a relatively less dense cushioning dunnage product having lateral pillow portions and a central connecting portion.

21. A method as set forth in claim 19, wherein the storing step includes using a stock roll of a multi-ply sheet material which is biodegradable, recyclable, and composed of a renewable resource.

22. A method as set forth in claim 19, further comprising the steps of storing at least one stock roll on another stock roll storage rack, and interchanging the stock roll storage racks relative to the conversion machine after one has been emptied the other one filled with at least one stock roll.

23. A method as set forth in claim 19, further comprising the step of adjusting the height of the stock roll storage rack on a stand therefor to correspond with the height of the cushioning conversion machine.

24. A method as set forth in claim 19, wherein the stock roll holder includes a pair of laterally spaced apart stock roll supports, and the method comprises the step of supporting the ends of a spindle on which the stock roll is supported on the stock roll supports.

25. A method as set forth in claim 19, wherein the stock roll storage rack includes a pair of laterally spaced apart rails, and the method comprises the step of supporting the ends of a spindle on which the stock roll is supported on the laterally spaced apart rails.

26. A method as set forth in claim 19, wherein a spindle on which the stock roll is supported has adjacent one end thereof a stop collar, and the method comprises inserting the spindle into a stock roll until the stop collar abuts an end of the stock roll.

27. A method of loading a roll of sheet stock material onto a stock roll holder which supports the stock roll for rotation so that the sheet stock material can be payed out to conversion assemblies for conversion into a relatively lower density cushioning dunnage product, said method comprising the steps of:

storing at least one stock roll on a stock roll storage rack positioned adjacent the stock roll holder and configured to support the stock roll at the same level as the stock roll holder; and moving the stock roll along a loading ramp and onto the stock roll holder; wherein said moving step includes moving the stock roll through a transition region downstream of said stock roll storage rack and wherein said method further comprises the step of catching the stock roll in a window in said transition region.

28. A stock roll storage rack positionable adjacent a stock roll holder of a cushioning conversion machine, comprising a stand and a stock roll storage shelf mounted to said stand, said stock roll storage shelf including a tray having a bottom wall for supporting a plurality of stock rolls in a generally horizontal array for sequential loading onto the stock roll holder.

29. A stock roll storage rack as set forth in claim 28, wherein said bottom wall is inclined to horizontal.

30. A stock roll storage rack as set forth in claim 29, wherein said tray further includes an abutment at a rear end of said bottom wall and an exit passage at the forward end of the bottom wall; and said bottom wall is inclined to horizontal in a direction that causes the stock rolls supported thereon to roll rearwardly toward and against said abutment, whereby a leading one of the stock rolls must be rolled up a slight incline for loading onto the stock roll holder of the conversion machine.

31. A stock roll storage rack as set forth in claim 28, wherein said stock roll holder includes a pair of laterally spaced apart stock roll supports for supporting the ends of a spindle on which the stock roll can be supported for rotation, said stock roll storage rack has a loading ramp positionable at the same level as the stock roll supports, and said loading ramp includes a pair of laterally spaced apart ramp surfaces over which the ends of a stock roll spindle can pass for loading the stock roll onto the stock roll supports.

32. A stock roll storage rack as set forth in claim 28, wherein said stock roll storage shelf is mounted to said stand for vertical adjustment between a plurality of different heights.

33. A stock roll storage rack as set forth in claim 28, wherein said stock roll storage shelf is cantilevered to one side of said stand.

* * * * *